US011268707B2

(12) United States Patent
Qin

(10) Patent No.: US 11,268,707 B2
(45) Date of Patent: Mar. 8, 2022

(54) AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Qiang Qin, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 223 days.

(21) Appl. No.: 16/675,829

(22) Filed: Nov. 6, 2019

(65) Prior Publication Data

US 2020/0208849 A1 Jul. 2, 2020

Related U.S. Application Data

(63) Continuation of application No. PCT/CN2019/109135, filed on Sep. 29, 2019.

(30) Foreign Application Priority Data

Dec. 29, 2018 (CN) ..... 201822272124.1

(51) Int. Cl.
*F24F 1/0011* (2019.01)
*F24F 1/0068* (2019.01)
*F24F 1/0063* (2019.01)

(52) U.S. Cl.
CPC ..... *F24F 1/0011* (2013.01); *F24F 1/0063* (2019.02); *F24F 1/0068* (2019.02)

(58) Field of Classification Search
CPC ..... F24F 1/0011; F24F 1/0068; F24F 1/0063; F24F 1/0057; F24F 1/0007; F24F 13/084; F24F 2013/205; F24F 2221/22
See application file for complete search history.

(56) References Cited

U.S. PATENT DOCUMENTS 8,627,672 B2 * 1/2014 Moteki ..... F24F 13/32 62/263
2016/0298870 A1 * 10/2016 Sun ..... F24F 1/0025
2020/0141610 A1 * 5/2020 Qin ..... F24F 13/085

FOREIGN PATENT DOCUMENTS

CN 107062397 A 8/2017
CN 107388374 A 11/2017
(Continued)

OTHER PUBLICATIONS

Intellectual Property Office of Korea (IPKR) the Office Action for KR Application No. 10-2019-7036214 dated Dec. 17, 2020 13 Pages (Translation Included).
(Continued)

*Primary Examiner* — Joseph F Trpisovsky
(74) *Attorney, Agent, or Firm* — Anova Law Group PLLC

(57) ABSTRACT

An air conditioner indoor unit includes a housing. The housing includes a chassis and a face frame connected to the chassis. A lower portion of the face frame includes an opening. the indoor unit further includes an air passage member disposed at the chassis and exposed from the opening, and a lower panel including an air outlet communicating with the air passage member. A first side of the lower panel is rotatably connected to a first side edge of the opening or a first side of the air passage member, and a second side of the lower panel is detachably connected to a second side edge of the opening or a second side of the air passage member.

17 Claims, 11 Drawing Sheets

(56) References Cited

FOREIGN PATENT DOCUMENTS

| | | | |
|---|---|---|---|
| CN | 107388385 | A | 11/2017 |
| CN | 206626684 | U | 11/2017 |
| CN | 107420987 | A | 12/2017 |
| CN | 206755349 | U | 12/2017 |
| CN | 206817722 | U | 12/2017 |
| CN | 206905122 | U | 1/2018 |
| CN | 206905239 | U | 1/2018 |
| CN | 207094789 | U | 3/2018 |
| CN | 207407442 | U | 5/2018 |
| CN | 208059068 | U | 11/2018 |
| CN | 209310235 | U | 8/2019 |
| JP | H109606 | A | 1/1998 |
| JP | 2004245571 | A | 9/2004 |
| JP | 2004293887 | A | 10/2004 |
| JP | 2009115348 | A | 5/2009 |
| JP | 2017044411 | A | 3/2017 |
| KR | 20100043987 | A | 4/2010 |

OTHER PUBLICATIONS

The European Patent Office (EPO) Supplementary Search Report for EP Application No. 19794865.6, dated Aug. 4, 2020 1 Page.
The European Patent Office (EPO) Extended Search Report for EP Application No. 19794865.6, dated Jul. 15, 2020 8 Pages.
World Intellectual Property Organization (WIPO) Written Opinion for PCT/CN2019/109135 dated Sep. 29, 2019 9 Pages(Translation Included).
World Intellectual Property Organization (WIPO) International Search Report for PCT/CN2019/109135 dated Sep. 29, 2019 22 Pages(Translation Included).
Intellectual Property Office of Korea (IPKR) the Office Action for KR Application No. 10-2019-7036214 dated Jun. 28, 2021 13 Pages (Translation Included).
Japan Patent Office (JPO) the Office Action for JP Application No. 2019-561952 dated May 11, 2021 6 Pages (Translation Included).
Japan Patent Office (JPO) the Notice of Reasons for Refusal for JP Application No. 2019-561952 dated Oct. 12, 2021 7 Pages (Translation Included).

* cited by examiner

C-C

D-D

AIR CONDITIONER INDOOR UNIT AND AIR CONDITIONER

CROSS REFERENCE TO RELATED APPLICATIONS

This application is a continuation of PCT Application No. PCT/CN2019/109135, filed on Sep. 29, 2019, which claims priority to Chinese Patent Application No. 201822272124.1, entitled "AIR CONDITIONER INDOOR UNIT AND AIR CONDITIONER," filed on Dec. 29, 2018, the entire contents of both of which are incorporated herein by reference.

TECHNICAL FIELD

The present disclosure relates to the technical field of air conditioning equipment, and in particular, to an air conditioner indoor unit and an air conditioner using the indoor unit.

BACKGROUND

A traditional air conditioner indoor unit usually has a non-detachable housing, which faces the air passage member. After the air conditioner has been used for a long time, dust is likely to accumulate in the wall of the air passage member and the cross-flow wind wheel, it is difficult to clean the air passage member without removing the face frame. Besides, when there is a problem with the motor of the air guiding structure, it is also not easy to replace and repair the motor.

SUMMARY

The main objective of the present disclosure is to provide an air conditioner indoor unit, aiming at improving the convenience of cleaning the air conditioner indoor unit.

In order to achieve the above objective, the present disclosure provides an air conditioner indoor unit, including:

a housing including a chassis, and a face frame connected to the chassis, a lower portion of the face frame including an opening;

an air passage member disposed at the chassis and exposed from the opening; and a lower panel including an air outlet communicating with the air passage member, a side of the lower panel on a front-rear direction is rotatably connected to a side edge of the opening or a side of the air passage member, and another side of the lower panel is detachably connected to another side edge of the opening or another side of the air passage member, and the lower panel is rotated to open or cover the opening for exposing or shielding the air passage member.

Optionally, the air conditioner indoor unit further includes a heat exchanger installed in the housing, a refrigerant pipe connected with the heat exchanger and including a connector, and a cover plate. The chassis includes a dismounting hole, the lower panel includes an avoiding hole corresponding to the dismounting hole, and the connector of the refrigerant pipe is exposed from the dismounting hole and the avoiding hole, and the cover plate is detachably connected to a lower periphery of the avoiding hole for closing or opening the avoiding hole and the dismounting hole.

Optionally, an outer periphery of the avoiding hole includes a first locking structure, an inner side wall of the cover plate includes a second locking structure, and the cover plate is detachably connected to the lower panel through the first locking structure and the second locking structure.

Optionally, the air conditioner indoor unit further includes a locking member, a periphery of the air outlet includes a connecting hole, the air passage member includes a mounting hole corresponding to the connecting hole, and the locking member passes through the connecting hole and the mounting hole for connecting the lower panel with the air passage member.

Optionally, a side of the lower panel on the front-rear direction includes a rotation shaft, an edge of the opening near a front side of the face frame includes a shaft hole matching the rotation shaft, and the lower panel is rotated from rear to front to open the opening.

Optionally, the lower panel includes at least one pair of rotation shafts, and the rotation shaft is one of the rotation shafts, the opening includes at least one pair of shaft holes, and the shaft hole is one of the shaft holes. Openings of one pair of the shaft holes are faced with each other, and one pair of the rotation shafts are spaced apart from each other and rotatably cooperating with the shaft holes, each rotation shaft is rotatably received in one corresponding shaft hole; and/or the rotation shaft is connected to the lower panel through a rotation arm, and a side edge of the shaft hole is provided with a limiting protrusion, and the limiting protrusion is configured to abut the rotation arm to position the lower panel after the lower panel is rotated to a limiting angle.

Optionally, an outer periphery of the shaft hole includes a guiding surface, and the rotation shaft is slid into the shaft hole along the guiding surface.

Optionally, an end surface of the rotation shaft includes a mating surface, and the rotation shaft is slid into the shaft hole along the mating surface.

Optionally, an outer periphery of the shaft hole includes a guiding surface, an end surface of the rotation shaft includes a mating surface, and the rotation shaft is slid into the shaft hole with the mating surface against the guiding surface.

Optionally, an edge of the opening near a rear side of the chassis includes a buckle hole, and another side of the lower panel includes a buckle inserted in the buckle hole.

Optionally, the buckle is in a plate shape and vertically protruded from an inner side of the lower panel, and a free end of the buckle is bent rearwards, and the buckle hole is flared in shape.

Optionally, an edge of the opening near a rear side of the chassis includes a snap fastener assembly, and another side of the lower panel includes a lock head locked with the snap fastener assembly.

Optionally, the lock head has a columnar structure with different diameters in different areas;

the snap fastener assembly includes:

a cylinder structure, an end of the cylindrical structure including a hole;

a large slider installed in the cylinder structure and internally provided with a circulating guide;

a spring disposed between the large slider and the cylinder structure;

two jaws connected with the large slider and exposed out of the hole of the cylinder structure; and a swinging needle connected with the cylinder structure and the large slider, the swinging needle is hooked in the circulating guide.

Optionally, one of a middle portion of each end of the lower panel on a left-right direction and a middle portion of the corresponding edge of the opening in the left-right direction includes a clamping hole, and other one includes a clamping member cooperating with the clamping hole.

Optionally, the air conditioner indoor unit further includes an upper panel, a side of the upper panel is rotatably connected to an upper side of the face frame, and another side of the upper panel is fitted to the lower panel.

Optionally, the front side of the face frame includes a mounting hole, the mounting hole being covered by the upper panel.

Optionally, both ends of the upper panel include a cover, the covers covering outer side walls of the face frame, and both ends of the lower panel include a flange protruded towards the face frame, and an outer wall surfaces of each of the flanges is coplanar with one corresponding outer wall surface of the cover after the opening is covered by the lower panel.

Optionally, the air conditioner indoor unit further includes an air guiding assembly, the air guiding assembly is detachably connected to an edge of the air outlet; or the air guiding assembly is mounted at the face frame and disposed facing the air outlet.

Optionally, the air passage member includes a wind wheel, a volute tongue and a volute both provided on the chassis, the volute tongue cooperates with the volute to form an air passage communicating with the air outlet, and the wind wheel is located within the air passage.

The present disclosure further provides an air conditioner including an air conditioner indoor unit, the air conditioner indoor unit including:

a housing including a chassis, and a face frame connected to the chassis, a lower portion of the face frame including an opening;

an air passage member disposed at the chassis and exposed from the opening; and a lower panel including an air outlet communicating with the air passage member, a side of the lower panel on a front-rear direction is rotatably connected to a side edge of the opening or a side of the air passage member, and another side of the lower panel is detachably connected to another side edge of the opening or another side of the air passage member, and the lower panel is rotated to open or cover the opening for exposing or shielding the air passage member.

In the technical solutions of the present disclosure, a lower portion of a housing of an air conditioner indoor unit includes an opening, an air passage member can be exposed from the opening, a lower panel is rotatably connected to the opening or an edge of the air passage member, and the lower panel is rotated to open the opening for exposing the air passage member. As such, a large space is left for cleaning the air passage member, which improves the convenience of cleaning. Besides, another side of the lower panel is detachably connected to the housing or the air passage member, such that the installation of the lower panel on the housing is more stable, thereby preventing the lower panel from being accidentally opened to cause danger. Therefore, the structural stability of the air conditioner indoor unit is improved, and the working performance is improved.

BRIEF DESCRIPTION OF THE DRAWINGS

In order to more clearly illustrate the embodiments of the present disclosure, the drawings used in the embodiments will be briefly described below. Obviously, the drawings in the following description are only some embodiments of the present disclosure. It will be apparent to those skilled in the art that other figures can be obtained from the structures illustrated in the drawings without the inventive effort.

DESCRIPTION OF REFERENCE NUMERALS

Figure 1:
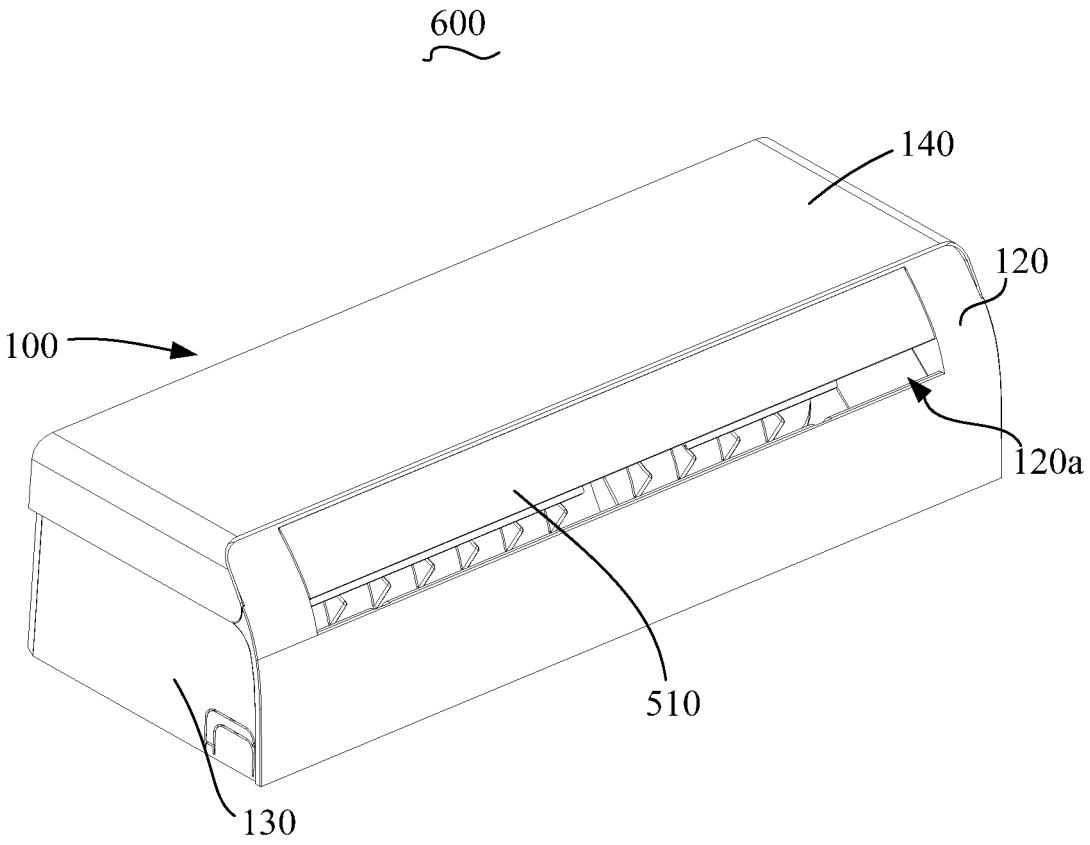
FIG. 1 is a schematic perspective structural view of an air conditioner indoor unit according to an embodiment of the present disclosure.

| Reference Numeral | Name |
|---|---|
| 100 | Housing |
| 110 | Chassis |
| 111 | Base plate |
| 113 | Dismounting hole |
| 120 | Lower panel |
| 120a | Air outlet |
| 121 | Rotation shaft |
| 1211 | Mating surface |
| 122 | Buckle |
| 123 | Clamping hole |
| 124 | Flange |
| 125 | Connecting hole |
| 126 | Avoiding hole |
| 130 | Face frame |
| 130a | Air inlet |
| 130b | Opening |
| 131 | Shaft hole |
| 132 | Guiding surface |
| 133 | Buckle hole |
| 134 | Clamping member |
| 135 | Limiting protrusion |
| 140 | Upper panel |
| 141 | Cover |
| 150 | Cover plate |
| 200 | Heat exchanger |
| 210 | Front heat exchange member |
| 220 | Rear heat exchange member |
| 230 | Refrigerant pipe |
| 300 | Air passage member |
| 310 | Volute |
| 311 | Front water tray |
| 313 | Rear water tray |
| 314 | Mounting hole |
| 320 | Air passage |
| 330 | Wind wheel |

-continued

| Reference Numeral | Name |
|---|---|
| 400 | Electric control box |
| 500 | Air guiding assembly |
| 510 | Air guiding plate |
| 600 | Air conditioner indoor unit |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be described in the following with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It is to be understood that, all of the directional indications in the embodiments of the present disclosure (such as top, bottom, left, right, front, rear, etc.) can only be used for explaining relative position relations, moving condition of the elements under a special form (referring to figures), and so on. If the special form changes, the directional indications may change accordingly.

In the present disclosure, unless specified or limited otherwise, the terms "connected," "fixed," and the like are used broadly. For example, "fixed" can refer to fixed connections, detachable connections, or integrated as one part; may refer to mechanical or electrical connections; may refer to direct connections or indirect connections via intervening structures, may also be inner connecting of two elements, or interaction relationship between two elements. For those skilled in the art, the specific meanings of the above terms in the present disclosure can be understood according to specific situations.

In addition, the descriptions, such as "first" and "second" in the embodiments of present disclosure, are only for descriptive purposes, and should not be understood as indicating or suggesting relative importance or impliedly indicating the number of the indicated technical character. Therefore, a character indicated by the "first," or the "second" can expressly or impliedly include at least one such character. Besides, the technical solutions of various embodiments can be combined with each other as long as they do not conflict with each other.

The present disclosure provides an air conditioner indoor unit 600.

In the present disclosure, as shown in FIG. 1 to FIG. 12, the air conditioner indoor unit 600 includes:

a housing 100, where the housing 100 includes a chassis 110 and a face frame 130 connected to the chassis 110, a lower portion of the face frame 130 including an opening 130*b;* an air passage member 300 disposed at the chassis 110 and exposed from the opening 130*b*; and a lower panel 120 including an air outlet 120*a* communicating with the air passage member 300, where a side of the lower panel 120 in a front-rear direction is rotatably connected to a side edge of the opening 130*b* or a side of the air passage member 300, and another side of the lower panel 120 in the front-rear direction is detachably connected to another side edge of the opening 130*b* or another side of the air passage member 300, and the lower panel 120 is rotated to open or cover the opening 130*b* for exposing or shielding the air passage member 300.

In the present embodiment, the air conditioner indoor unit 600 includes the housing 100. The housing 100 includes the chassis 110 and the face frame 130. The face frame 130 and the chassis 110 enclose to form a mounting cavity. A heat exchanger 200 and the air passage member 300 are mounted in the mounting cavity, and the heat exchanger 200 is disposed above the air passage member 300. The surface of the chassis 110 facing away from the face frame 130 is detachably connected with a wall panel (not shown), and the air conditioner indoor unit 600 is mounted to the wall through the wall panel. The top wall of the face frame 130 of the present disclosure includes an air inlet 130*a*, that is, the air conditioner indoor unit 600 is ventilated from the top. The air conditioner indoor unit 600 includes an air outlet 120*a* communicating with the mounting cavity. The outside air enters the air conditioner indoor unit 600 through the air inlet 130*a*. After the outside air is exchanged by the heat exchanger 200, it is blown out through the air outlet 120*a* by the driving of the air passage member 300.

The lower portion of the face frame 130 includes an opening 130*b* corresponding to the air passage member 300. The air passage member 300 includes a wind wheel 330, a volute tongue, a volute 310, a water tray disposed at the volute 310, and an air guiding assembly, such that the air passage member 300 located inside the opening 130*b* can be exposed when the lower panel 120 is opened, and the air passage member, the volute tongue, the water tray, the volute 310, and the wind wheel 330 are arranged sequentially in this order from the outside to the inside. The volute 310 of the present disclosure may be integrated with the chassis 110. Alternatively, the volute 310 may be separate from the chassis 110, but may be fixedly mounted with the chassis 110 to form one part. The heat exchanger 200 includes at least a front heat exchange member 210 and a rear heat exchange member 220 cooperating with the front heat exchange member 210 to form a downward flare, and the rear heat exchange member 220 is adjacent to the mounting wall. The volute tongue and volute 310 form an air passage 320, the wind wheel 330 is located within the air passage 320. The inlet of the air passage 320 communicates with the flare formed by the heat exchanger 200, the outlet of the air passage 320 communicates with the air outlet 120*b*. Under the driving of the wind wheel 330, the outside air enters through the air inlet 130*a*, passes through the air passage 320, and is blown out by the air outlet 120*a*.

The water tray at the volute 310 of the present disclosure may be divided into a front water tray 311 and a rear water tray 313. The front water tray 311 is configured to receive the condensed water generated during the heat exchange process of the front heat exchange member 210, and the rear water tray 313 is configured to receive the condensed water generated during the heat exchange process of the rear heat exchange member 220. At least one of the two ends of the water tray at the left-right direction includes an outlet hose. A drain pipe is connected to the outlet hose of the water tray to discharge the condensed water to the air conditioner indoor unit 600. The outlet hose is also exposed to the opening 130*b*, which makes it easier to disassemble or repair the drain pipe.

Besides, the air conditioner indoor unit 600 further includes an electric control box 400 disposed at one end of the heat exchanger 200. In order to facilitate the connection of wires of the air conditioner indoor unit 600, the electric control box 400 is also exposed to the opening 130*b*. Therefore, when the lower panel 120 is opened for cleaning or connecting the pipeline, it is also convenient to connect the wires, thereby further improving the installation efficiency.

In the technical solutions of the present disclosure, a lower portion of a housing 100 of an air conditioner indoor unit 600 includes an opening 130*b*, an air passage member 300 is exposed from the opening 130*b*, a lower panel 120 is rotatably connected to the opening 130*b* or an edge of the air passage member 300, and the lower panel 120 is rotated to open the opening 130*b* for exposing the air passage member 300. As such, a large space is left for cleaning the air passage member 300, which improves the convenience of cleaning. Besides, another side of the lower panel 120 on the front-rear direction is detachably connected to the housing 100 or the air passage member 300, such that the installation of the lower panel 120 on the housing 100 is more stable, thereby preventing the lower panel 120 from being accidentally opened to cause danger. Therefore, the structural stability of the air conditioner indoor unit 600 is improved, and the working performance is improved.

Figure 7:
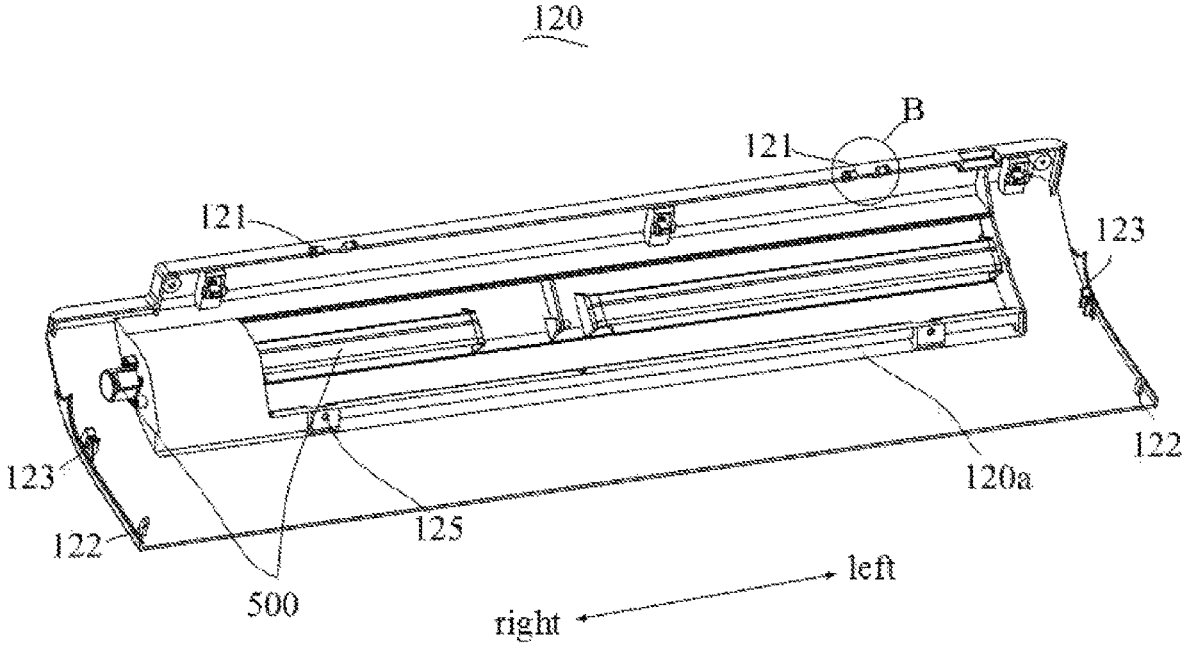
FIG. 7 is a schematic structural view of the lower panel in FIG. 6 from another viewing angle.
Figure 8:
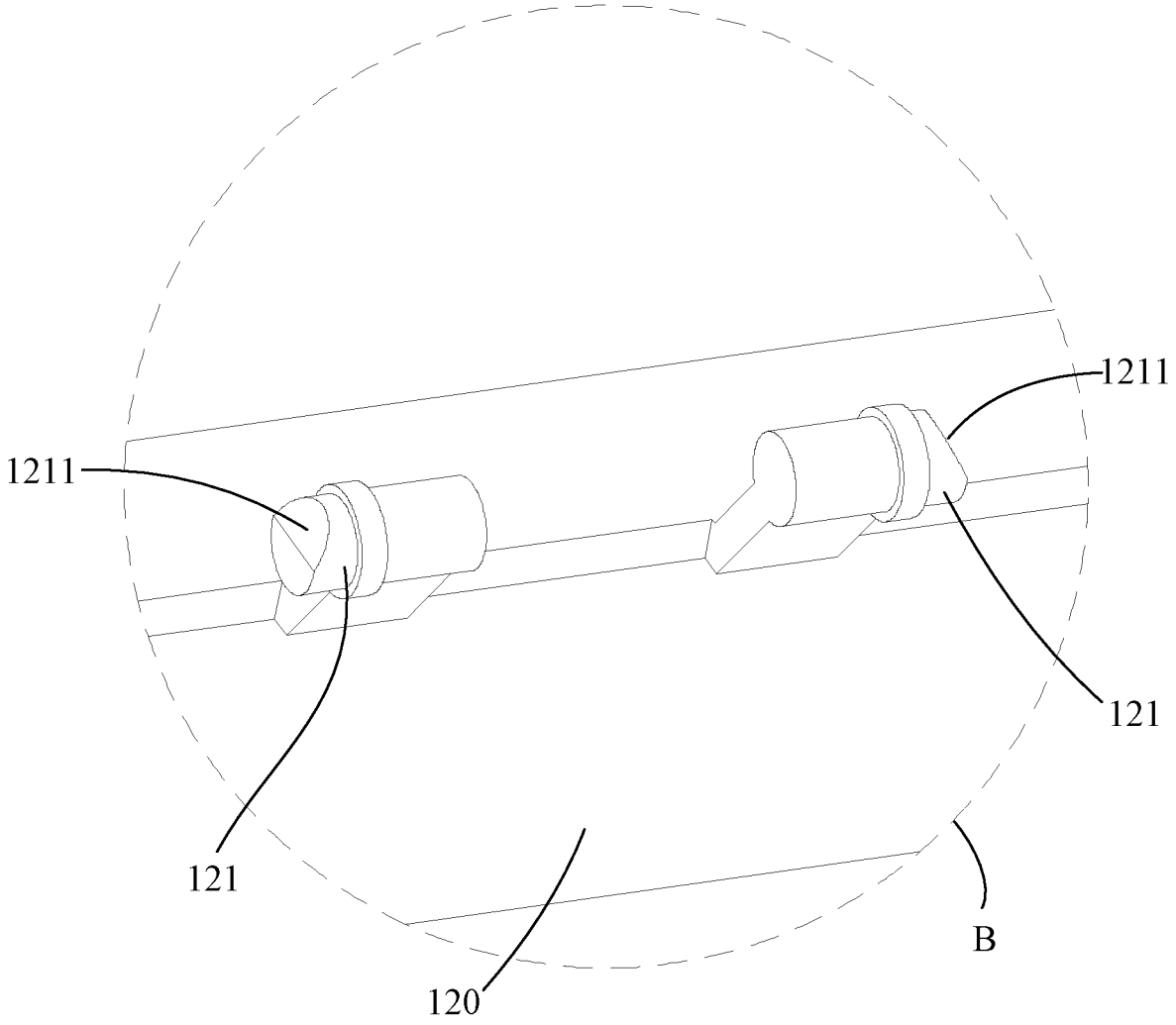
FIG. 8 is an enlarged view of portion B in FIG. 7.

Referring to FIG. 7, an air guiding assembly 500 is detachably connected to an edge of the air outlet 120*a*; or the air guiding assembly 500 is mounted at the face frame 130 and disposed facing the air outlet 120*a*.

In the present embodiment, the air guiding assembly 500 includes a louver assembly and an air guiding plate 510. The louver assembly may guide the wind of the air outlet 120*a* in the left-right direction, and the air guiding plate 510 is rotatably connected to the face frame 130 or the lower panel 120 to guide the wind of the air outlet 120*a* in the up-down direction. The cooperation of the louver assembly and the air guiding plate 510 can enhance the air blowing effect. In the present embodiment, the louver assembly is mounted at the chassis 110, the air guiding plate 510 is detachably connected to an edge of the air outlet 120*a*, and a driving motor is connected to one side of the air guiding plate 510. When the lower panel 120 is rotated and opened, the air guiding plate 510 and the driving motor can be repaired or cleaned, and the louver structure can be conveniently cleaned or repaired, thereby further improving the convenience of cleaning.

Figure 3:
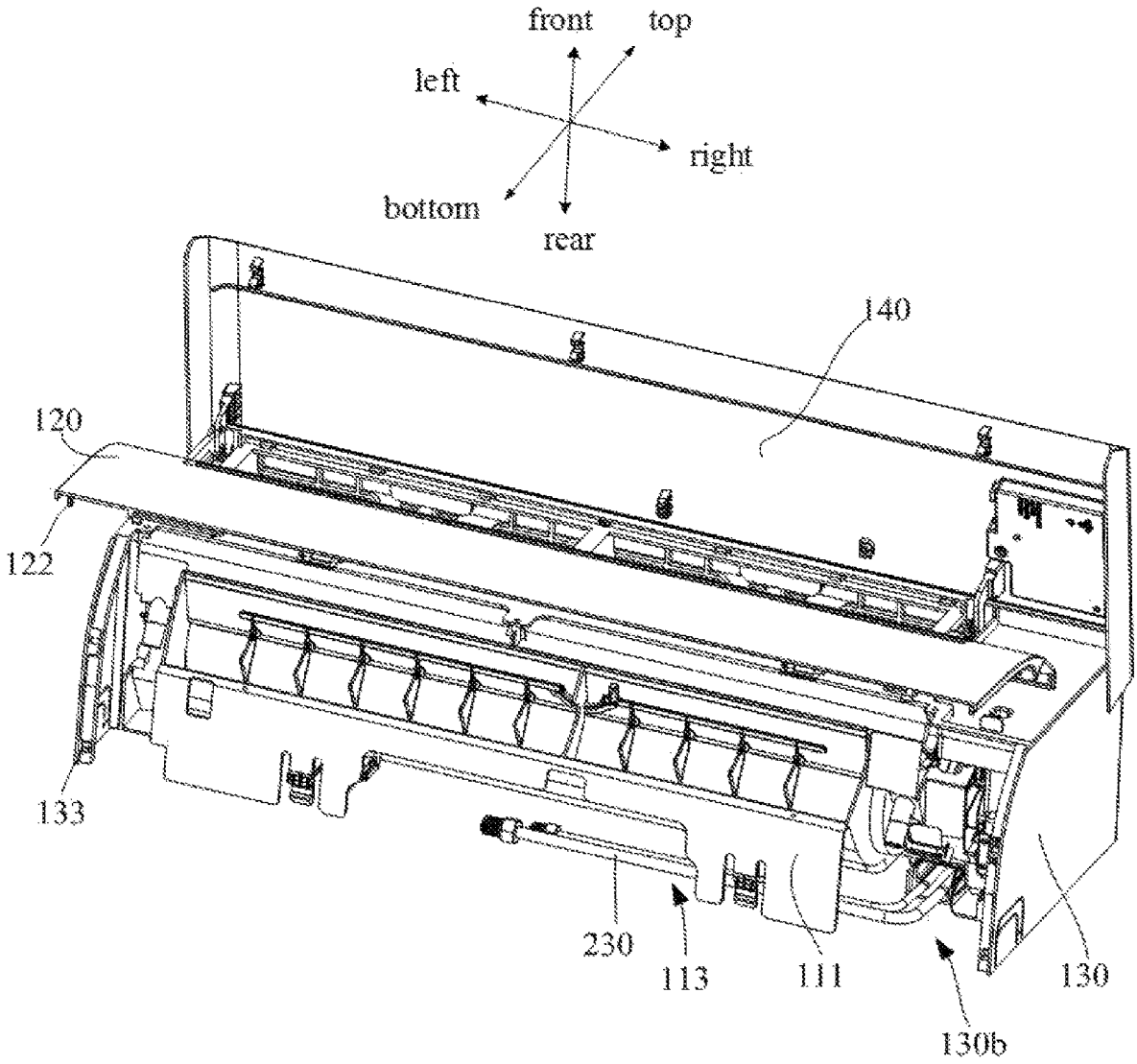
FIG. 3 is a schematic structural view of the air conditioner indoor unit when the upper panel and the lower panel of the air conditioner indoor unit in FIG. 1 are in an open state.
Figure 4:
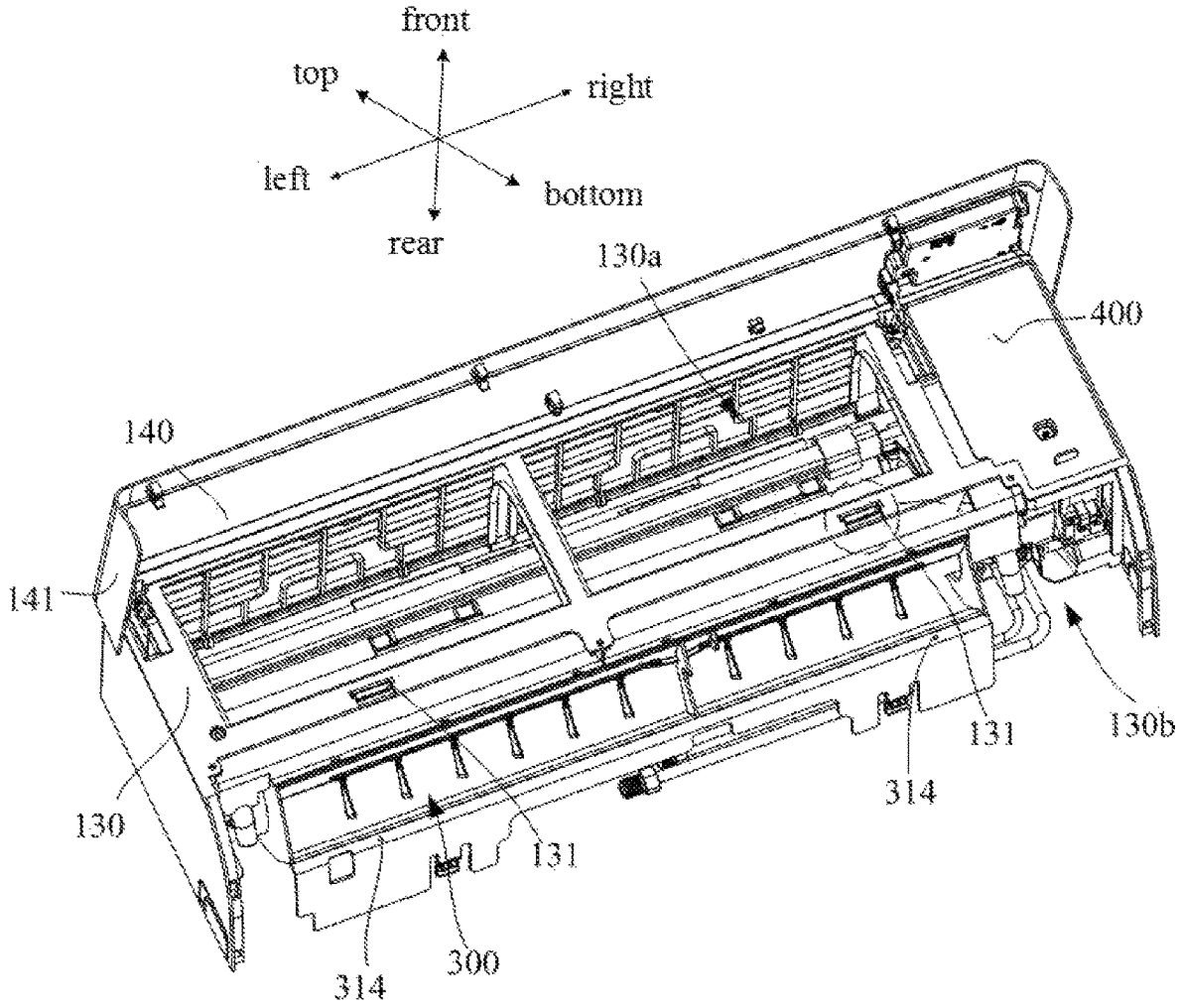
FIG. 4 is a schematic structural view of the air conditioner indoor unit when the lower panel of the air conditioner indoor unit in FIG. 1 is removed.
Figure 12:
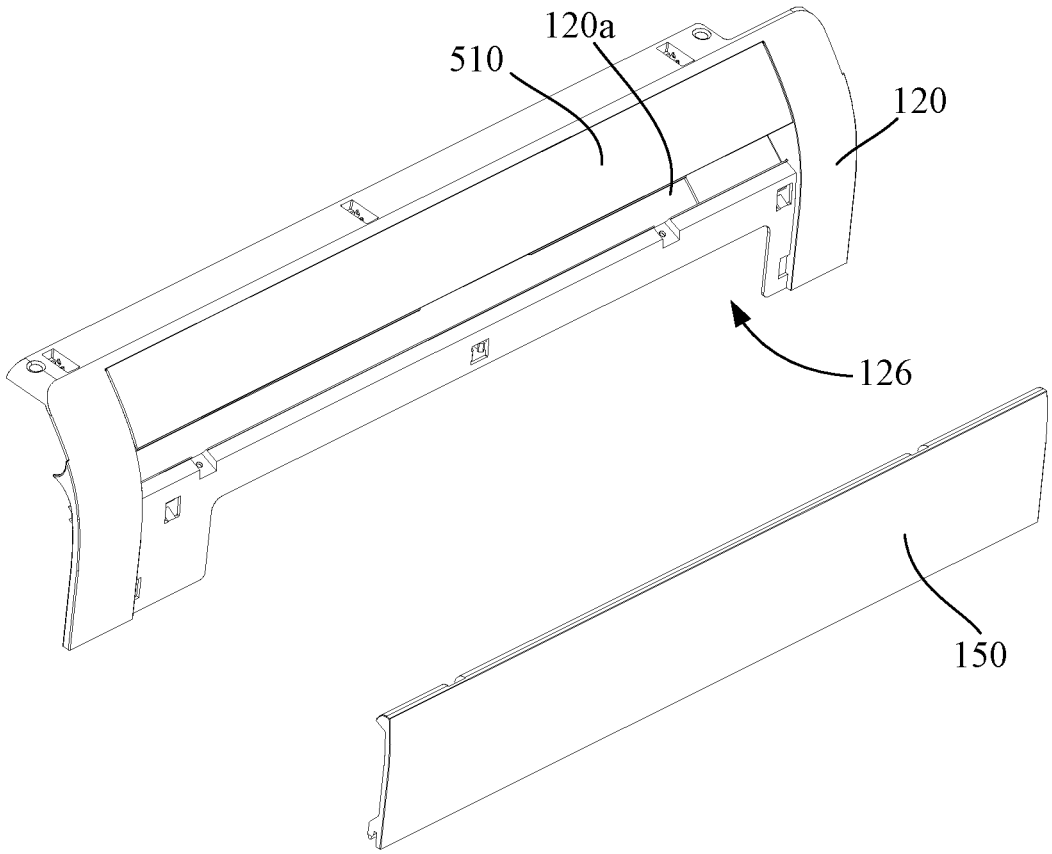
FIG. 12 is a schematic exploded view of the lower panel of the air conditioner indoor unit according to another embodiment of the present disclosure.

Referring to FIG. 3, FIG. 4 and FIG. 12, a refrigerant pipe 230 is connected with the heat exchanger 200. The chassis 110 includes a dismounting hole 113. The lower panel 120 includes an avoiding hole 126 corresponding to the dismounting hole 113, and a connector of the refrigerant pipe 230 is exposed from the dismounting hole 113 and the avoiding hole 126. The cover plate 150 is detachably connected to a periphery of the avoiding hole 126 for closing or opening the avoiding hole 126 and the dismounting hole 113.

The heat exchanger 200 is connected to the refrigerant pipe 230 so that a circulating refrigerant flow path is formed between the air conditioner indoor unit 600 and the outdoor unit of the air conditioner. Operations such as pipe cleaning need to be performed during the installation process or during the routine maintenance process of the air conditioner indoor unit 600, the air conditioner indoor unit 600 needs to be connected to the outdoor unit of the air conditioner to form a refrigerant pipe circulation path. In the present disclosure, a bottom plate 111 is disposed at a bottom of the chassis 110, and the bottom plate 111 includes a dismounting hole 113 that communicates with the mounting cavity. The lower panel 120 includes an avoiding hole 126 corresponding to the dismounting hole 113, and the connector of the refrigerant pipe 230 and the drain pipe can be exposed from the dismounting hole 113 and the avoiding hole 126. The cover plate 150 is connected to a periphery of the avoiding hole 126 for closing or opening the avoiding hole 126 and the dismounting hole 113. The dismounting hole 113 extends in the left-right direction of the air conditioner indoor unit 600 and is elongated, and the dismounting hole 113 may at least expose the connectors of the refrigerant pipe 230 and the drain pipe. The width of the dismounting hole 113 on the front-rear direction of the air conditioner indoor unit 600 should be suitable for the hand or the tool to be inserted to directly disassemble the refrigerant pipe 230 and the drain pipe.

Specially, an outer edge of the avoiding hole 126 includes a first locking structure. Correspondingly, an inner side wall of the cover plate 150 includes a second locking structure. The cover plate 150 is detachably connected to the lower panel 120 through the cooperation of the first locking structure and the second locking structure. The first locking structure may be clamped in, inserted in, rotatably connected to, or magnetically attached to the second locking structure, which is not limited here.

Figure 6:
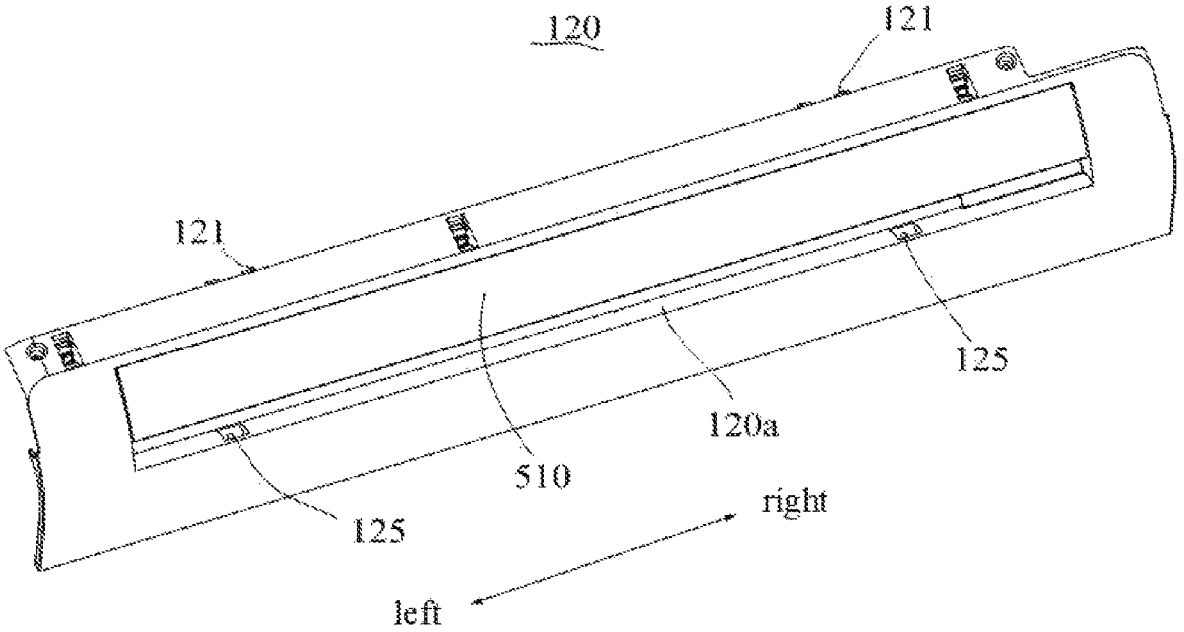
FIG. 6 is a schematic structural view of the lower panel of the air conditioner indoor unit in FIG. 1.

Referring to FIG. 4 and FIG. 6, optionally, a periphery of the air outlet 120*a* includes a connecting hole 125. The air passage member 300 includes a mounting hole 314 corresponding to the connecting hole 125. A locking member passes through the connecting hole 125 and the mounting hole 314 for connecting the lower panel 120 with the air passage member 300.

In the present embodiment, in order to increase the stability of the connection between the lower panel 120 and the face frame 130, a low periphery of the air outlet 120*a* includes at least one connecting hole 125, and the bottom plate 111 of the air passage member 300 includes a mounting hole 314 corresponding to the connecting hole 125. Since the air outlet 120*a* is located at a middle position of the lower panel 120 in the left-right direction, the locking member passes through the connecting hole 125 and the mounting hole 314, and the connection between the lower panel 120 and the middle portion of the face frame 130 can be increased, thereby increasing the stability of the connection between the lower panel 120 and the face frame 130. As such, it avoids that the two ends of the upper and lower sides are connected to cause a large gap in the middle, which affects the air volume and the air outlet effect.

Referring to FIG. 4 to FIG. 8, a side of the lower panel 120 on the front-rear direction includes a rotation shaft 121. An edge of the opening 130*b* near a front side of the face frame 130 includes a shaft hole 131 matching the rotation shaft 121. The lower panel 120 is rotated from rear to front to open the opening 130*b*.

In the present embodiment, the lower panel 120 is rotatably connected to the face frame 130 through the cooperation of the rotation shaft and the shaft hole. The lower panel 120 includes a rotation shaft 121 at an upper side of the lower panel 120. The face frame 130 includes a shaft hole 131 at lower portion of the front side of the face frame 130, i.e., near the edge of the opening 130*b*. The lower panel 120 is rotated more smoothly from front to rear with respect to the face frame 130 through the cooperation of the rotation shaft 121 and the shaft hole 131. At least one rotation shaft 121 is provided, and two rotation shafts 121 may be provided. The two rotation shafts 121 are disposed at two ends of one side of the lower panel 120, thereby improving the stability of the rotational connection. The lower panel 120 may also be rotatably connected to the face frame 130 through a plug-in jack structure, a rotating snap structure, or the like.

In a specific embodiment, the lower panel 120 includes at least one pair of rotation shafts 121, and the rotation shaft 121 described above is one of the rotation shafts 121. The face frame 130 includes at least one pair of shaft holes 131, and the shaft hole 131 described above is one of the shaft holes 131. One pair of the shaft holes 131 face with each other, and one pair of the rotation shafts 121 are spaced apart from each other, each rotation shaft 121 is rotatably received in one corresponding shaft hole 131; and/or the rotation shaft 121 is connected to the lower panel through a rotation arm, and a side edge of the shaft hole 131 is provided with a limiting protrusion 135, and the limiting protrusion 135 is configured to abut against the rotation arm to position the lower panel after the lower panel is rotated to a limiting angle.

In the present embodiment, one pair of the rotation shafts 121 are provided. One pair of the rotation shafts 121 include two rotation shafts 121 that are opposite to each other. Correspondingly, one pair of the shaft holes 131 include two shaft holes 131 that are opposite to each other, and an avoiding space is provided between the two shaft holes 131 to facilitate the rotation of the lower panel 120 and the installation of the rotation shaft 121. The structure is configured such that the cooperation between the two rotation shafts 121 and the two shaft hole 131 has a tendency to resist each other, so that the rotational connection is more stable, and there is no risk of accidental falling off, thereby improving the stability of the installation of the lower panel 120.

In order to further facilitate the rotation of the lower panel 120, a rotation arm is protruded from one side of the lower panel 120, and the other end of the rotation arm is connected to the rotation shaft 121. When the rotation shaft 121 is installed in the shaft hole 131, the rotation arm may abut against the side wall of the avoiding space, so that the rotation of the lower panel 120 is more stable. Meanwhile, in order to facilitate the cleaning or maintenance operation when opening the lower panel 120, a limiting protrusion 135 is provided, the limiting protrusion 135 is disposed at the periphery of a side of the shaft hole 131, and is located at the periphery of the opening 130*b* of the limiting space. When the rotation shaft 121 is rotated and opened from rear to front, it is rotated to a suitable limiting angle, the lower panel 120 is loosened. The limiting protrusion 135 may abut against the surface of the rotation arm in the rotating direction, thereby limiting the lower panel 120, thus improving the convenience and safety of cleaning.

Figure 5:
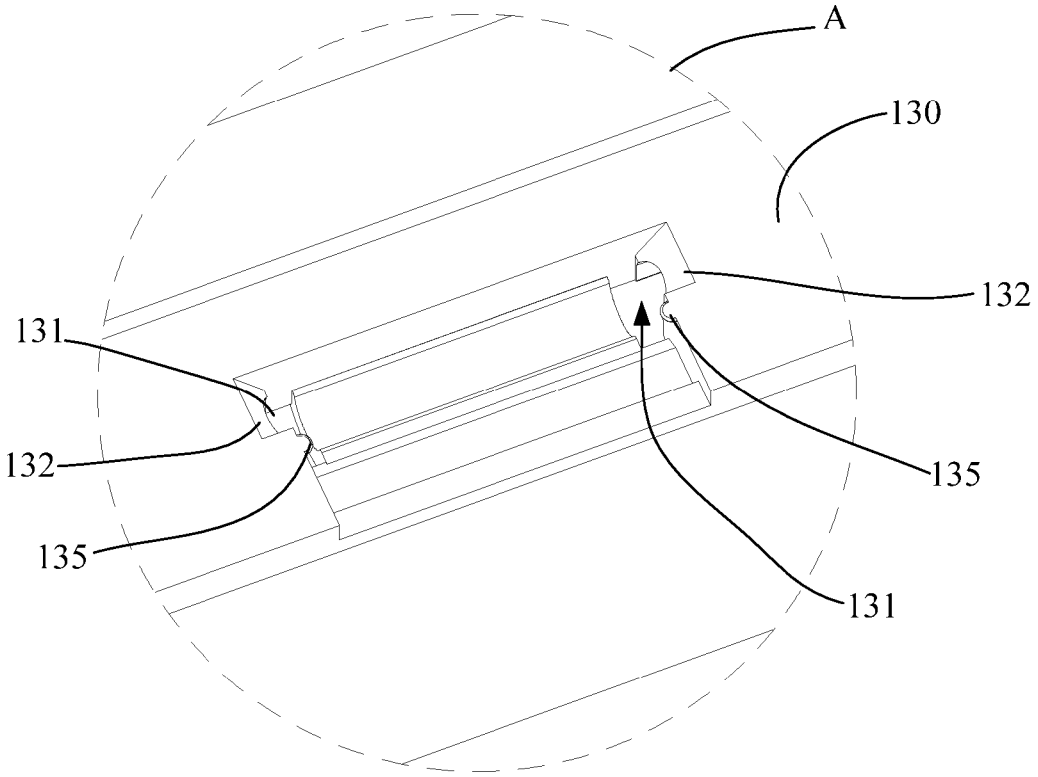
FIG. 5 is an enlarged view of portion A in FIG. 4.

Referring to FIG. 5 and FIG. 8 again, an outer periphery of the shaft hole 131 includes a guiding surface 132, and the rotation shaft 121 is slid into the shaft hole 131 along the guiding surface 132; or an end surface of the rotation shaft 121 includes a mating surface 1211, and the rotation shaft 121 is slid into the shaft hole 131 along the mating surface 1211; or an outer periphery of the shaft hole 131 includes a guiding surface 132, an end surface of the rotation shaft 121 includes a mating surface 1211, and the rotation shaft 121 is slid into the shaft hole 131 with the mating surface 1211 against the guiding surface 132.

In the present embodiment, an outer periphery of the shaft hole 131 includes a guiding surface 132. The guiding surface 132 gradually slopes towards the inside of the face frame 130 from one shaft hole 131 to the other shaft hole 131. An end surface of the rotation shaft 121 includes a mating surface 1211. The mating surface 1211 faces the shaft hole 131 and is parallel to the guiding surface 132. Therefore, when the lower panel 120 is installed, the mating surface 1211 of the two rotation shafts 121 is pressed against the guiding surface 132, and the rotation shaft 121 can be slid into the shaft hole 131, thereby improving the efficiency and convenience of installation.

Figure 9:
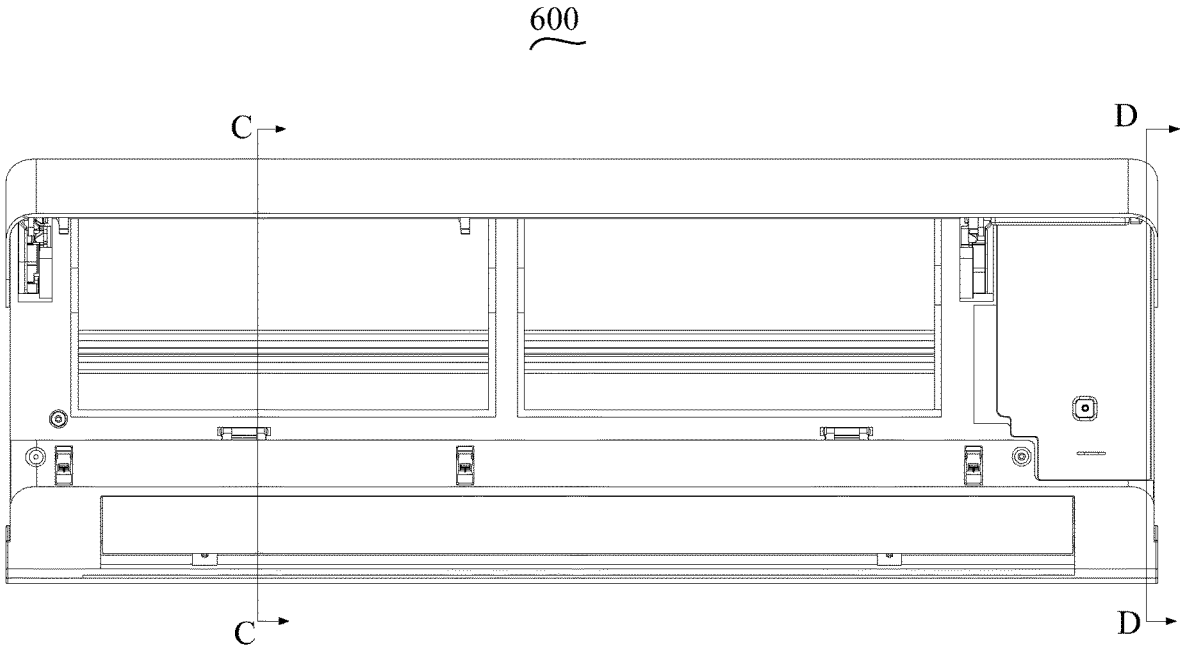
FIG. 9 is a schematic front structural view of the air conditioner indoor unit when the upper panel of the air conditioner indoor unit in FIG. 1 is in an open state.
Figure 10:
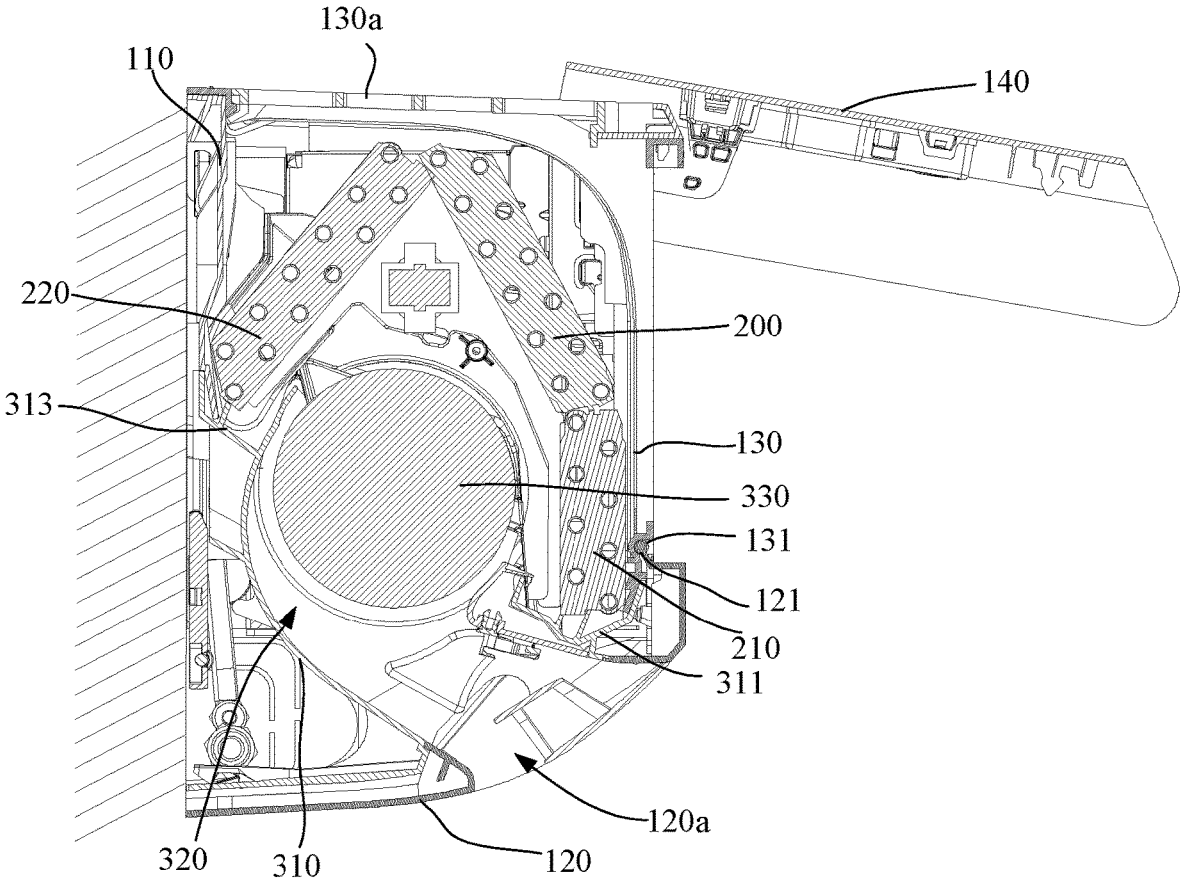
FIG. 10 is a cross-sectional view taken along line C-C in FIG. 9.
Figure 11:
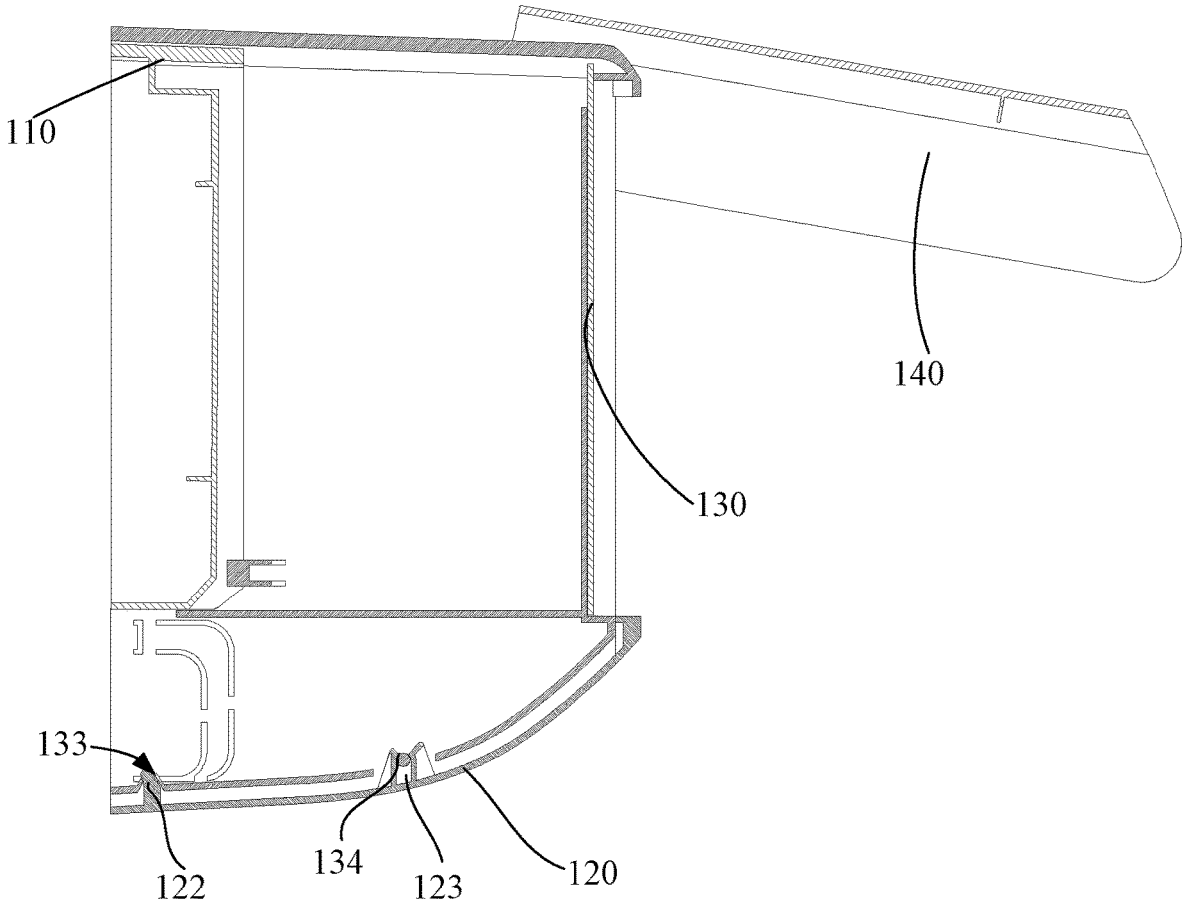
FIG. 11 is a cross-sectional view taken along line D-D in FIG. 9.

Referring to FIG. 9 to FIG. 11, an edge of the opening 130*b* near a rear side of the chassis 110 includes a buckle hole 133, and another side of the lower panel 120 includes a buckle 122 inserted in the buckle hole 133; or an edge of the opening 130*b* near a rear side of the chassis 110 includes a snap fastener assembly, and another side of the lower panel 120 includes a lock head locked with the snap fastener assembly.

In the present embodiment, when one side of the lower panel 120 is rotatably connected to the face frame 130, the other side of the lower panel 120 may be a buckle 122 connection to the face frame. For example, the other side of the lower plate 120 includes a buckle 122, and the face frame 130 includes a buckle hole 133 corresponding to the buckle 122. The lower panel 120 may be connected to the face frame 130 by pressing the other side of the lower panel 120, which is simple and convenient, and improves the convenience of disassembly and assembly. Specially, the buckle 122 is in a plate shape and vertically protrudes from an inner side of the lower panel 120, and a free end of the buckle 122 is bent rearwards, and the buckle hole 133 is flared in shape. The buckle 122 is inserted in the buckle hole 133, and the end portion thereof can effectively achieve the fastening. The snap structure may also be a cooperation of the lock head and the snap fastener assembly. Specially, the lock head has a columnar structure with different diameters in different areas. The snap fastener assembly includes: a cylinder structure, an end of the cylindrical structure including a hole; a large slider installed in the cylinder structure and internally provided with a circulating guide; a spring disposed between the large slider and the cylinder structure; two jaws connected with the large slider and extending out of the cylinder structure; and a swinging needle connected with the cylinder structure and the large slider. The swinging needle is hooked in the circulating guide. Thereby, when the lock head presses the large slider, the two jaws are driven to hold the lock head. When the lock head presses the large slider again, with the cooperation of the swinging needle, the large slider, the spring, and the circulating guide, the two jaws release the lock head to disable the connection state. The function of locking and unlocking can be completed only by repeating the pressing operations, which further saves time and effort. Besides, the detachable connection of the other side of the lower plate 120 to the face frame 130 may also be a magnetic attachment or a screw connection or the like, which is not limited here.

In an optional embodiment, one of a middle portion between two ends of the lower panel 120 in a left-right direction and a middle portion of an edge of the opening 130*b* in the left-right direction includes a clamping hole 123, and the other one includes a clamping member 134 cooperating with the clamping hole 123.

In the present embodiment, since both sides of the lower panel 120 are connected to the face frame 130, in order to add a connection between the two ends, a snap connection of the clamping hole 123 and the clamp member 134 is provided. Thereby, the connection stability of the lower panel 120 is further improved, and the airflow of the air passage 320 assembly can be prevented from being affected by gap.

Referring to FIG. 1 to FIG. 4, the air conditioner indoor unit 600 further includes an upper panel 140. A side of the upper panel 140 is rotatably connected to an upper side of the face frame 130, and another side of the upper panel 140 is fitted to the lower panel 120.

In the present embodiment, the front side of the face frame 130 includes a mounting hole, and the upper panel 140 covers the mounting hole for protection and decorative effects. In some embodiments, the air conditioner indoor unit 600 with the filter assembly can be detached from the mounting hole. In order to facilitate disassembly and assembly, the connection between the upper panel 140 and the face frame 130 is a rotational connection, which can be opened from rear to front. When the upper panel 140 covers the mounting hole, the other side of the upper panel 140 is fitted to the lower panel 120. The specific fastening manner may be a buckle 122, a lock, or a magnetic attachment. In the present embodiment, the inner side surface of the upper panel 140 includes a third snap structure, and the outer side wall of the lower panel 120 includes a fourth snap structure, and the upper panel 140 can be lightly pressed to realize locking, which is simple and convenient. In some embodiments, the upper panel 140 can also be fitted to the face frame 130 and disposed only in conjunction with the edge of the lower panel 120.

Figure 2:
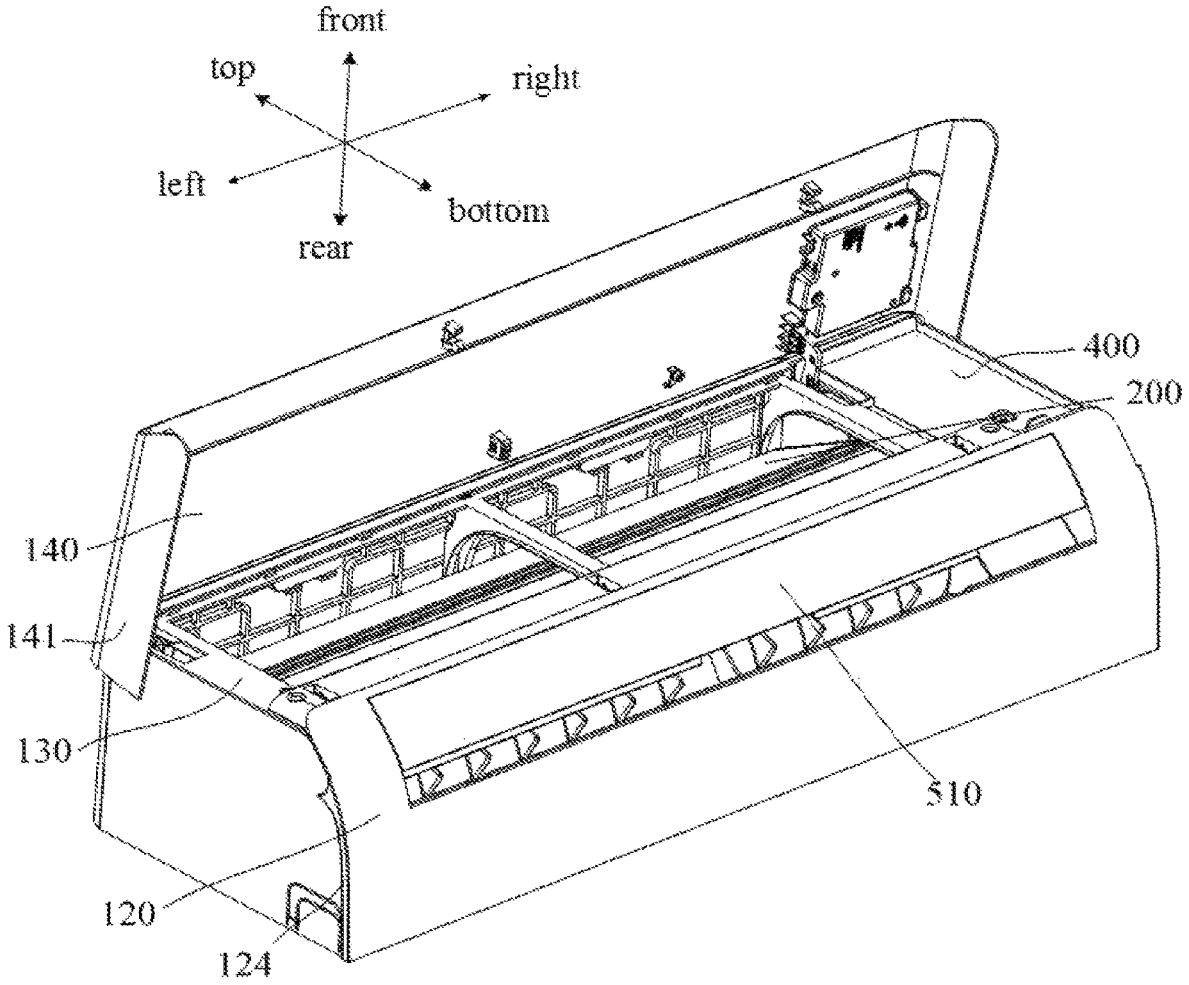
FIG. 2 is a schematic structural view of the air conditioner indoor unit when an upper panel of the air conditioner indoor unit in FIG. 1 is in an open state.

Referring to FIG. 1 and FIG. 2, two ends of the upper panel 140 each include a cover 141, the covers 141 covering outer side walls of the face frame 130. Two ends of the lower panel 120 each include a flange 124 protruding towards the face frame 130. An outer wall surface of each of the flanges 124 is coplanar with one corresponding outer wall surface of the cover 141 when the opening 130*b* is covered by the lower panel 120.

Or, both end surfaces of the lower panel 120 are coplanar with the outer wall surfaces of the face frame 130;

And/or, the rear end surface of the lower panel 120 is coplanar with the outer wall surface of the chassis 110.

In the present embodiment, the lower plate 120 may cover the opening 130*b* of the entire face frame 130, and the opening 130*b* includes the entire lower side space and a portion of the front side space of the face frame 130. Therefore, the rear end surface of the lower panel 120 directly abuts against the outer wall surface of the chassis 110, thereby achieving the function of completely covering the opening 130*b*. Of course, the rear end surface of the lower panel 120 can also be coplanar with the outer wall surface of the chassis 110 to directly abut against the wall or the wall panel. Both end surfaces of the lower plate 120 may be coplanar with the outer wall surfaces of the face frame 130 or may be wrapped around the outer wall surfaces of the face frame 130. Specifically, both ends of the lower panel 120 include a flange 124 convexly towards the face frame 130. The inner wall surface of the flange 124 abuts against the outer wall surface of the face frame 130 to form a covering structure. On the one hand, the sealing of the covering can be enhanced, and on the other hand, the stability of the rotation can be realized by using the flange 124, and the deviation in the left-right direction that causes the rotation to be unsmooth can be avoided. Correspondingly, two ends of the upper panel 140 also each include a cover 141, which can also provide a guiding rotation and can be tightly sealed. When the upper panel 140 covers the mounting hole, the outer wall surfaces of the cover 141 are coplanar with the outer wall surfaces of the flange 124, which can be more beautiful in appearance and further provides the tightness of the anastomotic connection.

The present disclosure further provides an air conditioner. The air conditioner includes an air conditioner indoor unit 600 and an outdoor unit of the air conditioner connected to the air conditioner indoor unit 600. The specific structure of the air conditioner indoor unit 600 refers to the above embodiments. Since all the technical solutions of all the above embodiments are adopted in the air conditioner, the air conditioner can realize at least all the effects brought by the technical solutions of the above embodiments, which are not repeated here.

The above are only some embodiments of the present disclosure, and do not limit the scope of the present disclosure. Equivalent structures or equivalent process transformations based on the present specification and the drawings, or the direct or indirect application of the present disclosure to other related technical fields, are all included in the scope of the present disclosure.

What is claimed is:

1. An air conditioner indoor unit, comprising:
- a housing including:
  - a chassis including a dismounting hole; and
  - a face frame connected to the chassis, a lower portion of the face frame including an opening;
- an air passage member disposed at the chassis and exposed from the opening;
- a lower panel including an avoiding hole corresponding to the dismounting hole and an air outlet communicating with the air passage member, a first side of the lower panel being rotatably connected to a first side edge of the opening or a first side of the air passage member, and a second side of the lower panel being detachably connected to a second side edge of the opening or a second side of the air passage member; and
- a cover plate detachably arranged below the avoiding hole.

2. The air conditioner indoor unit according to claim 1, further comprising:
- a heat exchanger installed in the housing; and
- a refrigerant pipe connected with the heat exchanger and including a connector;
- wherein:
  - the dismounting hole and the avoiding hole are configured to expose the connector.

3. The air conditioner indoor unit according to claim 2, wherein:
- the lower panel includes a first locking structure at an outer periphery of the avoiding hole;
- the cover plate includes a second locking structure at an inner side wall of the cover plate; and
- the cover plate is detachably connected to the lower panel through the first locking structure and the second locking structure.

4. The air conditioner indoor unit according to claim 1, further comprising:
- a locking member;
- wherein:
  - the lower panel includes a connecting hole at a periphery of the air outlet;
  - the air passage member includes a mounting hole corresponding to the connecting hole; and
  - the locking member passes through the connecting hole and the mounting hole.

5. The air conditioner indoor unit according to claim 1, wherein:
- the lower panel includes a rotation shaft at a side of the lower panel;

the face frame includes a shaft hole at an edge of the opening and matching the rotation shaft; and the lower panel is configured to rotate about the rotation shaft.

6. The air conditioner indoor unit according to claim 5, wherein:

the lower panel further includes a rotation arm connecting the rotation shaft to another portion of the lower panel; and the face frame further includes a limiting protrusion at a side edge of the shaft hole, the limiting protrusion being configured to abut against the rotation arm to position the lower panel when the lower panel is rotated to a limiting angle.

7. The air conditioner indoor unit according to claim 5, wherein:

an outer periphery of the shaft hole includes a guiding surface and the rotation shaft is configured to slide into the shaft hole along the guiding surface; or an end surface of the rotation shaft includes a mating surface and the rotation shaft is configured to slide into the shaft hole along the mating surface.

8. The air conditioner indoor unit according to claim 5, wherein:

an outer periphery of the shaft hole includes a guiding surface;

an end surface of the rotation shaft includes a mating surface; and the rotation shaft is configured to slide into the shaft hole with the mating surface against the guiding surface.

9. The air conditioner indoor unit according to claim 5, wherein:

an edge of the opening near a rear side of the chassis includes a buckle hole; and the lower panel further includes a buckle at another side of the lower panel, the buckle being inserted in the buckle hole.

10. The air conditioner indoor unit according to claim 9, wherein:

the buckle has a plate shape and vertically protrudes from an inner side of the lower panel, and a free end of the buckle is bent rearwards; and the buckle hole has a flared shape.

11. The air conditioner indoor unit according to claim 1, wherein:

the lower panel includes a pair of rotation shafts at a side of the lower panel and spaced apart from each other;

the face frame includes a pair of shaft holes at an edge of the opening, openings of the pair of shaft holes facing each other; and each of the rotation shafts is rotatably received in a corresponding one of the shaft holes.

12. The air conditioner indoor unit according to claim 1, further comprising:

a clamping hole at one of a first middle portion between two ends of the lower panel and a second middle portion of an edge of the opening; and a clamping member at another one of the first middle portion and the second middle portion, the clamping member cooperating with the clamping hole.

13. The air conditioner indoor unit according to claim 1, further comprising:

an upper panel;

wherein a side of the upper panel is rotatably connected to an upper side of the face frame, and another side of the upper panel is fitted with the lower panel.

14. The air conditioner indoor unit according to claim 13, wherein:

the upper panel includes two covers each at one of two ends of the upper panel, the covers covering outer side walls of the face frame;

the lower panel includes two flanges each at one of two ends of the lower panel and protruding towards the face frame; and an outer wall surface of each of the flanges is coplanar with an outer wall surface of a corresponding one of the covers when the opening is covered by the lower panel.

15. The air conditioner indoor unit according to claim 1, further comprising:

an air guiding assembly;

wherein:

the air guiding assembly is detachably connected to an edge of the air outlet; or the air guiding assembly is mounted at the face frame and faces the air outlet.

16. The air conditioner indoor unit according to claim 1, wherein the air passage member includes:

a volute tongue and a volute provided at the chassis and cooperating with each other to form an air passage communicating with the air outlet; and a wind wheel located within the air passage.

17. An air conditioner, comprising:

an indoor unit comprising:

a housing including:

a chassis including a dismounting hole; and a face frame connected to the chassis, a lower portion of the face frame including an opening;

an air passage member disposed at the chassis and exposed from the opening;

a lower panel including an avoiding hole corresponding to the dismounting hole and an air outlet communicating with the air passage member, a first side of the lower panel being rotatably connected to a first side edge of the opening or a first side of the air passage member, and a second side of the lower panel being detachably connected to a second side edge of the opening or a second side of the air passage member; and a cover plate detachably arranged below the avoiding hole.

* * * * *